US008449067B2

(12) United States Patent
Schulmeister

(10) Patent No.: US 8,449,067 B2
(45) Date of Patent: May 28, 2013

(54) METHOD FOR OPERATING AN INKJET PRINTING APPARATUS

(75) Inventor: Peter Schulmeister, Pfaffenhofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 1463 days.

(21) Appl. No.: 11/639,897

(22) Filed: Dec. 15, 2006

(65) Prior Publication Data

US 2007/0165079 A1 Jul. 19, 2007

(30) Foreign Application Priority Data

Dec. 16, 2005 (DE) ..... 10 2005 060 785

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 5,043,740 | A | 8/1991 | Kneezel et al. | |
| 5,103,731 | A * | 4/1992 | Williams et al. | 101/467 |
| 5,448,269 | A | 9/1995 | Beauchamp et al. | |
| 5,576,744 | A | 11/1996 | Niikura et al. | |
| 6,050,675 | A | 4/2000 | Bartolome | |
| 6,471,315 | B1 | 10/2002 | Kurata | |
| 6,871,941 | B2 | 3/2005 | Horti et al. | |
| 2003/0189611 | A1 | 10/2003 | Fan et al. | |
| 2004/0090478 | A1 | 5/2004 | Miller | |
| 2005/0078134 | A1 | 4/2005 | Igarashi | |

FOREIGN PATENT DOCUMENTS

| | | |
|---|---|---|
| JP | 08090776 | 4/1996 |
| JP | 8090776 | 4/1996 |

OTHER PUBLICATIONS

United Kingdom Search Report dated Apr. 10, 2007 for corresponding United Kingdom application GB0625094.8.

* cited by examiner

*Primary Examiner* — Julian Huffman
(74) *Attorney, Agent, or Firm* — Cozen O'Connor

(57) ABSTRACT

A method for operating an inkjet printing device with at least one inkjet printhead having a row of nozzles through which ink can be directed onto the substrate to be printed, which is guided over a cylinder or over a curved guide element. The inkjet printhead or each inkjet printhead is oriented transversely to the transport direction of the substrate, so that the nozzles in the row of the inkjet printhead or of each inkjet printhead are different distances away from the substrate to be printed. To print the substrate, the nozzles in the nozzle row of the inkjet printhead or of each inkjet printhead are actuated in such a way that that the differences in the nozzle to substrate travel time caused by the different distances between the nozzles in each row and the substrate to be printed are equalized or compensated.

3 Claims, 2 Drawing Sheets

METHOD FOR OPERATING AN INKJET PRINTING APPARATUS

BACKGROUND OF THE INVENTION

1. Field of the Invention

The invention pertains to a method for operating an inkjet printing apparatus with at least one inkjet printhead having a row of nozzles for directing ink onto a substrate being conveyed on a curved guide element in a transport direction.

2. Description of the Related Art

In printing presses which operate according to the offset printing principle, especially web-fed rotary presses and sheet-fed presses, increasing use is being made of inkjet printing devices, which serve primarily to individualize the printed materials produced by offset printing by adding to them, for example, barcodes, numbering, or other types of labeling. These inkjet printing devices have at least one inkjet printhead, which can be designed according to the so-called "continuous" inkjet principle, the drop-on-demand inkjet principle, the thermal inkjet principle, the bubble inkjet principle, or any of the other inkjet principles. The inkjet printheads usually have a row of nozzles consisting of several adjacent nozzles, through which the ink can be directed onto the substrate to be printed.

In many applications of inkjet printing devices, it is necessary to use a large number of inkjet printheads, some arranged transversely to the transport direction of the substrate, i.e., transversely to the printing direction, and others arranged in the printing direction. The required number of inkjet printheads transverse to the printing direction is defined primarily by the desired print resolution in relation to the given print resolution of the selected inkjet printhead and by the desired overall printing width relative to the printing width of an inkjet printhead. The required number of inkjet printheads in the printing direction is determined primarily by two factors: first, the fact that the desired printing speed is greater than the given printing speed of an inkjet printhead, and, second, the fact that several printing inks are to be applied to the substrate by the inkjet printing device.

This can lead to the situation that a large number of inkjet printheads in the inkjet printing device must be arranged next to each other in an array-like or matrix-like manner both transversely to the printing direction and in the printing direction.

Regardless of whether the inkjet printing device used to print the substrate has several inkjet printheads arranged in an array or only a single inkjet printhead, the print resolution transverse to the printing direction is determined primarily by the distance between the nozzles adjacent to each other in the row of the inkjet printhead. To increase the print resolution despite this limitation, it is already known according to the prior art that the inkjet printheads of an inkjet printing device can be oriented at a slant to the transport direction of the substrate and thus to the printing direction. The result is that the effective distance between the nozzles transverse to the printing direction or transport direction of the substrate is reduced, which means that the print resolution can be increased.

If an inkjet printing device of this type with printheads which have rows of nozzles arranged at a slant to the printing or transport direction of the substrate is used to print the substrate as it is being guided over a cylinder or over a curved surface, the problem occurs that the printed image can be distorted. So far there are no approaches known according to the prior art which can be taken to avoid these types of distortions.

SUMMARY OF THE INVENTION

According to the invention, the nozzles in the nozzle row of the inkjet printhead or of each inkjet printhead are actuated in such a way that the differences in the nozzle to substrate travel time caused by the different distances between the nozzles in the row and the substrate to be printed are equalized or compensated.

According to the inventive method, the different distances between the nozzles and the substrate to be printed caused by the slanted orientation of the rows of nozzles in the inkjet printheads of an inkjet printing device relative to the printing direction are compensated, with the result that the differences in the travel time of the ink caused by the different distances are compensated. Distortions of the printed image are thus avoided, and the quality of the printing can ultimately be increased.

According to a first embodiment of the invention, a bitmap of the image to be printed by the inkjet printhead or by each inkjet printhead is adjusted in a preprinting stage so that the image data assigned to the nozzles which are farther away from the substrate to be printed are shifted in the bitmap to a position situated earlier with respect to the printing direction than the image data assigned to the nozzles which are closer to the substrate to be printed.

According to a second, alternative embodiment of the invention, the nozzles in the nozzle row of the inkjet printhead or of each inkjet printhead which are farther away from the substrate to be printed are actuated and therefore opened earlier than the nozzles which are closer to the substrate to be printed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
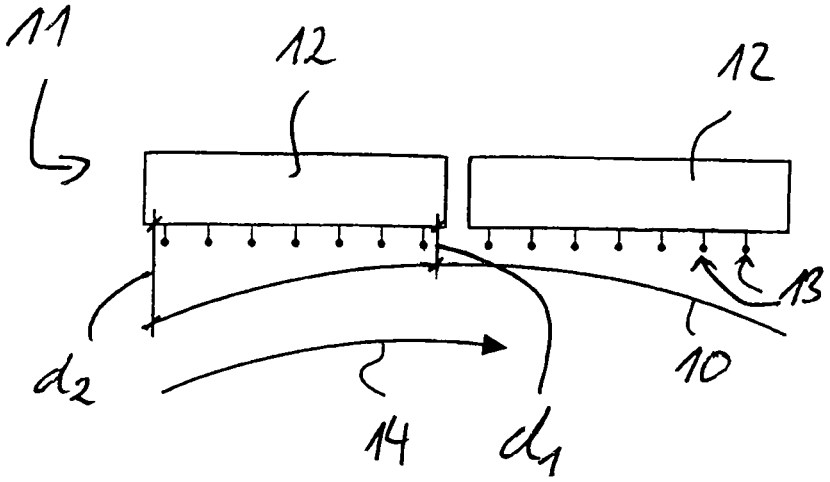
FIG. 1 shows a schematic diagram, from the side, of an inkjet printing device set up in the area of a cylinder.
Figure 2:
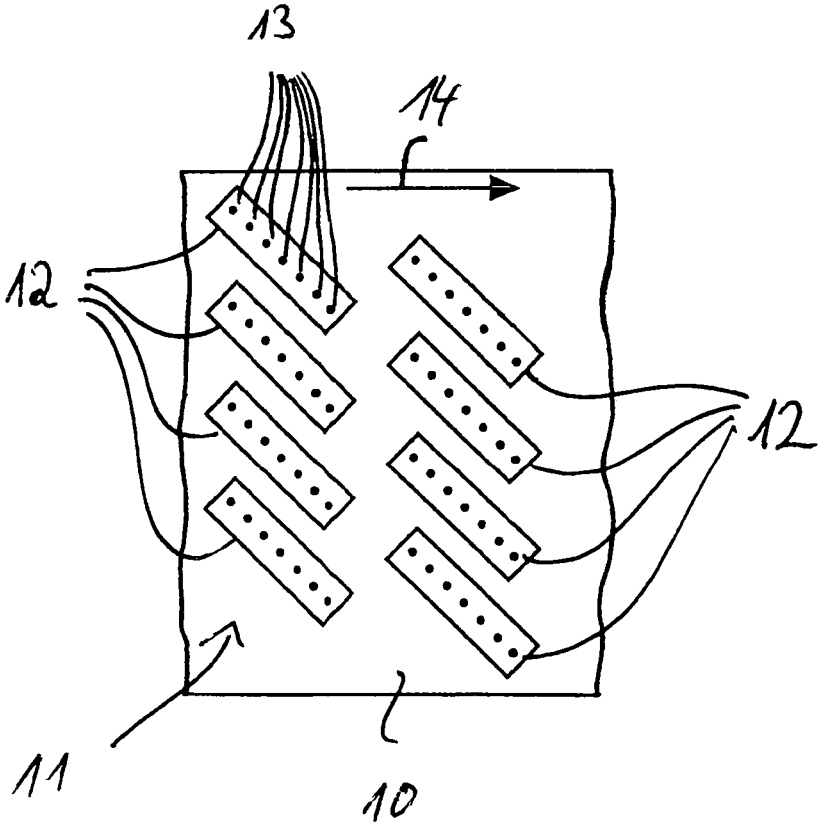
FIG. 2 shows a schematic diagram, from above, of the inkjet printing device of FIG. 1.

FIGS. 1 and 2 show in highly schematic fashion an inkjet printing device 11 installed in the area of a cylinder 10 of an offset press, where, in the exemplary embodiment according to FIGS. 1 and 2, the inkjet printing device 11 has a total of eight individual inkjet printheads 12. Each of the inkjet printheads has, according to FIGS. 1 and 2, one nozzle row consisting of several adjacent nozzles 13, where ink can be applied through the nozzles 13 to the substrate being guided over the cylinder 10. To simplify the diagram, the substrate itself is not shown in FIGS. 1 and 2. The substrate, however, is carried past the inkjet printheads 12 of the inkjet printing device 11 by the cylinder 10 in a transport direction indicated by the arrow 14. The transport direction visualized by the arrow 14 corresponds to the printing direction.

The inkjet printheads 12 of the inkjet printing device 11 are positioned in an array-like or matrix-like manner, where two inkjet printheads 12 are arranged one behind the other in the printing direction (arrow 14), and four inkjet printheads 12 are arranged next to each other transversely to the printing direction.

To increase the resolution of the inkjet printheads 12, i.e., of the inkjet printing device 11, the inkjet printheads 12 are arranged at a slant to the printing direction or transport direction of the substrate, with the result that the nozzles 13 arranged in a row in each inkjet printhead 12 are different distances away from the cylinder 10 and thus from the substrate to be printed. Thus, in FIG. 1, the distances $d_1$ and $d_2$ labeled for the inkjet printhead 12 on the left show that, as a result of the slanted positioning of the nozzle rows relative to the printing direction, each of the individual nozzles 13 in the row is a different distance from the cylinder 10 and thus from the substrate to be printed.

Figure 3:
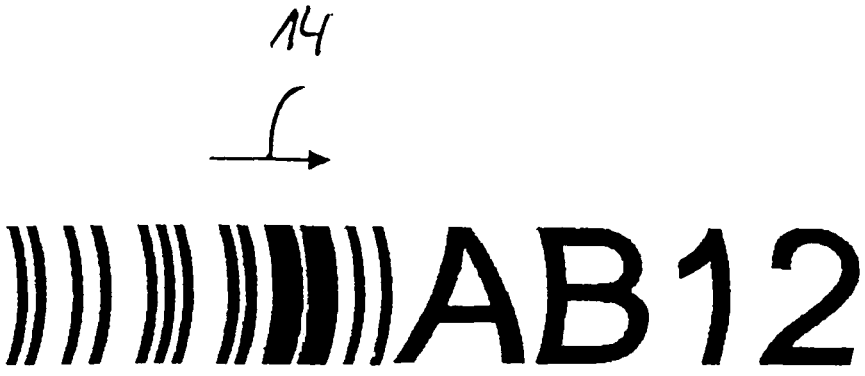
FIG. 3 shows a printed image obtained according to the prior art with the use of the inkjet printing device according to FIGS. 1 and 2.

When an inkjet printing device of this type is used to print by the method known from conventional practice, distortions are formed in the resulting printed image, as can be seen by way of example in FIG. 3. These distortions impair the print quality and are avoided by the use of the present invention.

Figure 4:
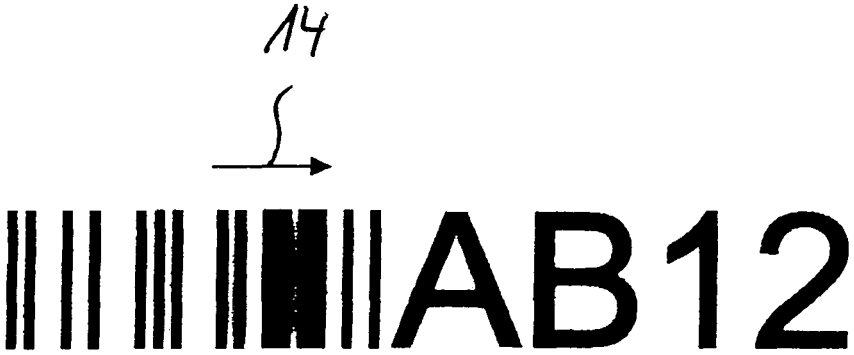
FIG. 4 shows a printed image obtained according to the inventive method with the use of the inkjet printing device according to FIGS. 1 and 2.

To prevent the distortions in the printed image shown in FIG. 3, the present invention proposes a method for operating an inkjet printing device in which, to print the substrate, the nozzles 13 in the rows of the inkjet printheads 12 are actuated in such a way that the differences in the ink-to-substrate travel time caused by the different distances between the nozzles 13 of each row and the substrate to be printed are equalized or compensated. The present invention is therefore based on the insight that the different distances between the nozzles and the substrate to be printed caused by the previously described slanted arrangement of the inkjet printheads 12 relative to the cylinder 10, which defines the printing direction 14, result in different ink travel times and thus to different landing positions of the ink on the substrate. These resulting travel-time differences are equalized or compensated according to the invention, so that distortions of the printed image as shown in FIG. 3 are avoided and a printed image such as that shown in FIG. 4 is obtained.

According to a first embodiment of the present invention, a so-called bitmap of the image to be printed by the inkjet printheads 12 is adjusted in a preprinting stage to compensate or to equalize the previously mentioned travel-time differences. The bitmap is adjusted in such a way that the image data assigned to the nozzles which are farther away from the substrate to be printed are shifted in the bitmap to a position which is situated earlier in the printing direction than the image data assigned to the nozzles which are closer to the substrate to be printed. The bitmap is adjusted under consideration of the conditions pertaining to the inkjet printheads and under consideration of the printing speed. If printing is to be carried out at several different printing speeds, a separate adjusted bitmap is preferably prepared for each printing speed. According to this variant, there is no need to modify the hardware of the inkjet printing device or of the inkjet printheads. According to this variant, the inventive compensation of the travel-time differences of the ink is implemented exclusively by adjusting the bitmap during the preprinting stage.

According to a second alternative embodiment of the present invention, the previously described differences in the ink-to-substrate travel-time are equalized or compensated by actuating and thus opening the nozzles in the row of the inkjet printhead 12 which are farther away from the substrate to be printed sooner than the nozzles which are closer to the substrate to be printed, so that the ink which must travel a longer distance because it is farther away from the substrate leaves the associated nozzle of the inkjet printhead sooner, by an appropriate amount of time. According to this variant, the bitmap of the image to be printed remains unchanged; the different ink travel times corresponding to the actual distance of the individual nozzles from the substrate to be printed are corrected continuously in an automatic control circuit as a function of the printing speed during printing; that is, the corrections are made in real time by the hardware controller of the inkjet printheads 12.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating an inkjet printing device with at least one inkjet printhead having a row of nozzles for directing ink onto a substrate being conveyed in a transport direction over a cylinder in an offset press, said method comprising arranging said at least one printhead transversely of said transport direction so that adjacent nozzles lie at different distances from the substrate, whereby the ink from adjacent nozzles has different nozzle to substrate travel times;

generating a bitmap of an image to be printed on the substrate by each said printhead, each said bitmap comprising image data assigned to respective nozzles;

adjusting each said bitmap in a pre-printing stage so that image data assigned to nozzles which are farther away from the substrate is shifted upstream in the printing direction relative to image data for nozzles which are closer to the substrate; and actuating the nozzles in each said row so that the different nozzle to substrate travel times for the nozzles of each row are compensated by the adjusted bitmap.

2. The method of claim 1 wherein each said bitmap is generated as a function of printing speed.

3. The method of claim 1 wherein the image data is shifted upstream by an amount proportional to the distance of the respective nozzles from the substrate.

* * * * *